US009580967B2

(12) United States Patent
Galey et al.

(10) Patent No.: US 9,580,967 B2
(45) Date of Patent: Feb. 28, 2017

(54) INCREASING FORMATION STRENGTH THROUGH THE USE OF TEMPERATURE AND TEMPERATURE COUPLED PARTICULATE TO INCREASE NEAR BOREHOLE HOOP STRESS AND FRACTURE GRADIENTS

(71) Applicant: SHELL OIL COMPANY, Houston, TX (US)

(72) Inventors: Robert Loran Galey, The Woodlands, TX (US); Lisa Shave Grant, New Orleans, LA (US); Jeffrey Robert Scheibal, Mandeville, LA (US); James Brett Wieseneck, Mandeville, LA (US); Arthur Herman Hale, Houston, TX (US); Mary Elizabeth Egan, New Orleans, LA (US); Nor Janiah Japar, Mandeville, LA (US); Arno Laurentius Michael Van Den Haak, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 181 days.

(21) Appl. No.: 14/175,603

(22) Filed: Feb. 7, 2014

(65) Prior Publication Data

US 2014/0151045 A1 Jun. 5, 2014

Related U.S. Application Data

(63) Continuation-in-part of application No. PCT/US2013/063681, filed on Oct. 7, 2013.

(60) Provisional application No. 61/711,310, filed on Oct. 9, 2012.

(51) Int. Cl.

| | |
|---|---|
| ***E21B 36/00*** | (2006.01) |
| ***E21B 7/14*** | (2006.01) |
| ***E21B 33/13*** | (2006.01) |
| ***E21B 43/10*** | (2006.01) |

(52) U.S. Cl.

CPC ..... *E21B 7/14* (2013.01); *E21B 33/13* (2013.01); *E21B 36/006* (2013.01); *E21B 36/008* (2013.01); *E21B 43/10* (2013.01)

(58) Field of Classification Search

CPC ..... E21B 21/003; E21B 33/13; E21B 36/00; E21B 36/001; E21B 36/006; E21B 36/04; E21B 36/02

See application file for complete search history.

(56) References Cited

U.S. PATENT DOCUMENTS

| | | | | |
|---|---|---|---|---|
| 5,103,909 | A | 4/1992 | Morgenthaler et al. | |
| 5,159,569 | A * | 10/1992 | Xu et al. | 702/13 |
| 6,973,977 | B2 | 12/2005 | Naquin | |

(Continued)

OTHER PUBLICATIONS

Bisheng Wu, "Wellbore Temperature and Thermo-elastic Stress Analyses During Drilling or Stimulation", 2011, CSIRO Earth Science and Resource Engineering, pp. 287-291.*

*Primary Examiner* — Kipp Wallace

(57) ABSTRACT

A method of increasing near-wellbore rock strength so as to mitigate or remediate lost circulation events through increased hoop stress in the near-wellbore in a subsurface formation comprises a) cooling a near-wellbore region of the formation, b) allowing a lost circulation material to enter the cooled near-wellbore region; and c) heating the near-wellbore region.

13 Claims, 6 Drawing Sheets

(56) References Cited

U.S. PATENT DOCUMENTS

| | | | | |
|---|---|---|---|---|
| 7,860,377 | B2 | 12/2010 | Vinegar et al. | |
| 8,162,059 | B2 | 4/2012 | Nguyen et al. | |
| 8,267,185 | B2 | 9/2012 | Ocampos et al. | |
| 2002/0188431 | A1* | 12/2002 | Ding et al. | 703/10 |
| 2004/0140095 | A1 | 7/2004 | Vinegar et al. | |
| 2004/0149431 | A1 | 8/2004 | Wylie et al. | |
| 2010/0089574 | A1 | 4/2010 | Wideman et al. | |
| 2013/0213638 | A1* | 8/2013 | Keller et al. | 166/248 |

* cited by examiner

INCREASING FORMATION STRENGTH THROUGH THE USE OF TEMPERATURE AND TEMPERATURE COUPLED PARTICULATE TO INCREASE NEAR BOREHOLE HOOP STRESS AND FRACTURE GRADIENTS

RELATED CASES

The present application is a continuation in part of PCT application No. PCT/US2013/063681, filed on 7 Oct. 2013, which claims priority to U.S. application Ser. No. 61/711,310, filed 9 Oct. 2012, both of which are incorporated herein in their entireties.

BACKGROUND

The present disclosure relates generally to wellbore operations. More specifically, the present disclosure relates to techniques for heating a subterranean formation surrounding a wellbore during various wellbore operations, such as drilling, casing and/or completing the wellbore.

Wellbores are drilled into the earth to locate and gather valuable hydrocarbons. Drilling tools with a bit at an end thereof may be advanced into the earth to form a wellbore. Drilling mud may be pumped from a surface pit, through the drilling tool and out the drill bit to flush the cuttings and cool the drilling tool during drilling. Upon exiting the drill bit, the drilling mud passes up the wellbore between the downhole tool and the wellbore, and returns back to the surface pit. The mud may be used to line the wellbore to prevent fluids from passing from the formation and into the wellbore, for example, in a blowout.

Testing tools, such as wireline, logging while drilling, measurement while drilling, or other downhole tools, may be deployed into the wellbore to measure various downhole parameters, such as temperature, pressure, etc. The downhole parameters may be used to analyze downhole conditions and/or to make decisions concerning wellsite operations.

In some cases, the wellbore may be provided with casing (or liner) deployed into the wellbore and cemented into place to line a portion of the wellbore. Cement may be pumped into the wellbore to secure the casing in place. The addition of casing and cement may be used to increase wellbore integrity about a portion of the wellbore.

Once cased, production tools may be deployed into the wellbore to draw production fluids through the wellbore and to the surface during a production operation. Various techniques have been developed to facilitate production. For example, simulation tools, such as injection tools, may be deployed into the wellbore to fracture the wellbore. Fluids, such as steam or other conduction fluids, may be injected into the formation with the injection tools. In some cases, heat may be applied to the wellbore during various operations and using various techniques, such as downhole heaters. Examples of heating at the wellsite are provided in U.S. Pat. Nos. 5,103,909, 6,973,977, 8,162,059, and 7,860,377. Temperature changes in the wellbore may affect various downhole conditions and/or operations.

SUMMARY

In at least one aspect, the disclosure relates to a method for reinforcing or strengthening a borehole wall in a subterranean formation so as to increase hoop stress in the near-wellbore. Preferred embodiments of the method include a) cooling a near-wellbore region of the formation, b) allowing lost circulation materials (LCM) to enter the cooled near-wellbore region, and c) heating the near-wellbore region.

Step a) may include lowering the temperature of the near-wellbore region by at least 10° F. (6° C.) or lowering the temperature of the near-wellbore region to 10° F. (6° C.) or below current near wellbore region temperature. Alternatively, step a) may include cooling the near-wellbore region sufficiently to reduce hoop stress in the near-wellbore region by at least 50 psi. Step a) may include cooling the near-wellbore region for at least 5 minutes and step c) and at least part of step b) may be carried out simultaneously.

The lost circulation materials, which may be fibrous or granular, may interact exothermically with fluid in the wellbore and may comprise particulate with wide particle size distribution or a fluid with thixotropic properties with or without exothermic properties.

Step c) may include raising the temperature of the near-wellbore region by at least 10° F. (6° C.) or raising the temperature of the near-wellbore region to at least 10° F. (6° C.) or above current near wellbore region temperature. Step c) may include heating the near-wellbore region sufficiently to increase hoop stress in the near-wellbore region by at least 50 psi and may include heating the near-wellbore region for at least 5 minutes.

As used herein, "near-wellbore" refers to that portion of the foundation surrounding the borehole and extending substantially radially from the borehole wall at least a distance substantially equal to the wellbore radius.

BRIEF DESCRIPTION OF THE DRAWINGS

So that the above recited features and advantages of the disclosure may be understood in detail, a more particular description of the disclosure, briefly summarized above, may be had by reference to the embodiments thereof that are illustrated in the appended drawings. It is to be noted, however, that the appended drawings illustrate only typical embodiments of this disclosure and are, therefore, not to be considered limiting of its scope. The figures are not necessarily to scale, and certain features and certain views of the figures may be shown exaggerated in scale or in schematic in the interest of clarity and conciseness.

DETAILED DESCRIPTION

The description that follows includes exemplary apparatuses, methods, techniques, and instruction sequences that embody techniques of the inventive subject matter. However, it is understood that the described embodiments may be practiced without these specific details.

The disclosure relates to techniques for cooling and heating a subterranean formation during various wellbore operations, such as drilling, casing, treating, cementing, etc. The heating may involve mechanical heating (e.g., by frictional motion of downhole equipment) and/or fluidic heating (e.g., by disposing fluids into the wellbore). Heating may be performed to achieve a desired temperature and/or using a desired fluid (e.g., drilling mud, designed treatment fluids and/or tailored cement slurries). The cooling and heating, with or without particulate and fibrous materials in the mud, are carried out with the objective of altering and to some extent stabilizing the hoop stress of the near-wellbore region of the formation and may have other desirable effects on properties of the subterranean formation, such as rock strength, zonal isolation, and/or wellbore integrity. Heating and cooling of the near-wellbore region may also be used to adjust downhole parameters (e.g., formation strength, salt mobility, formation stability, effective permeability,) and to adjust other formation parameters (e.g., fracture pressure, expanded rock pressure, fracture gradient, etc.).

Figure 1:
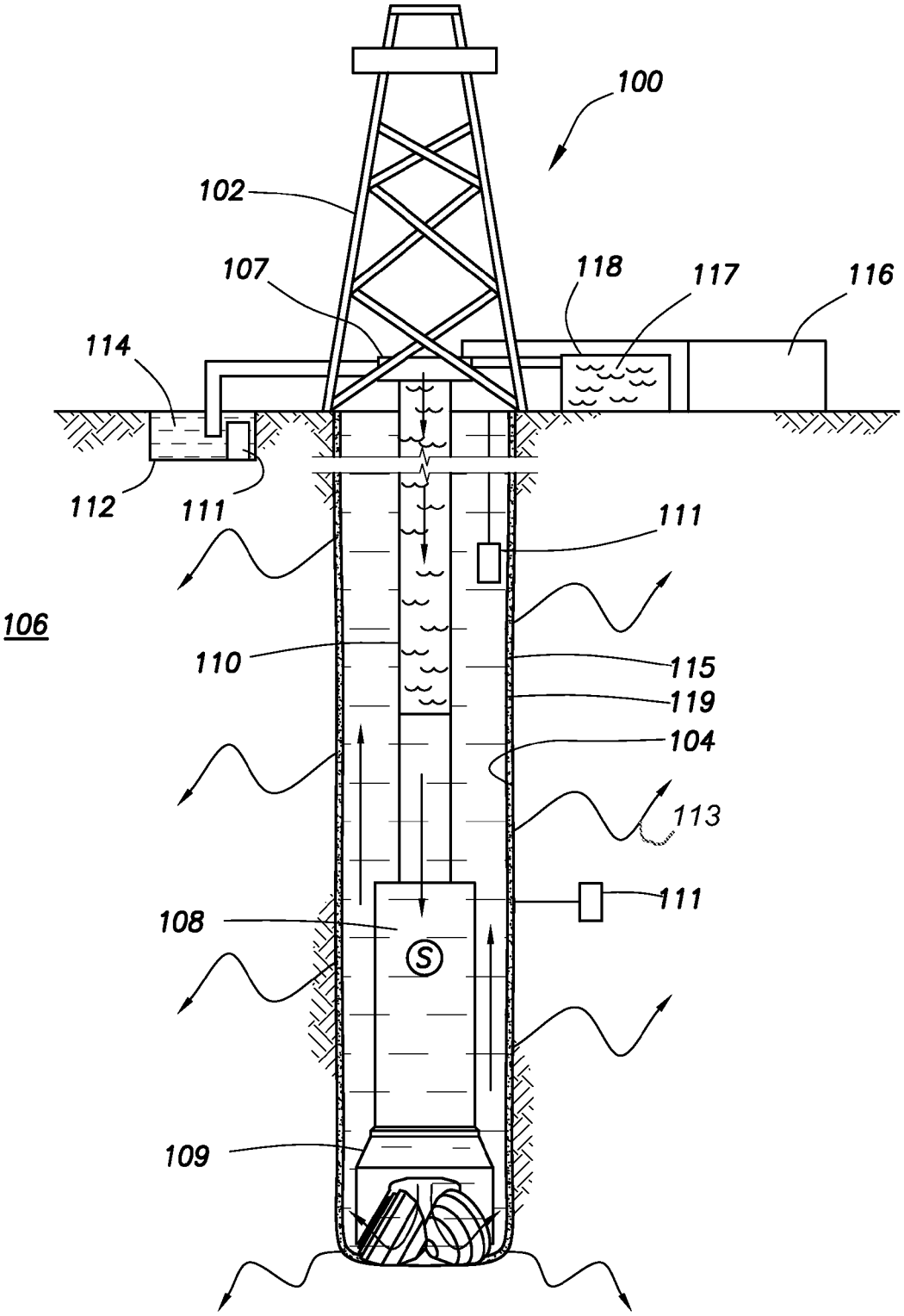
FIG. 1 is schematic diagram, partially in cross-section depicting heating while drilling a wellbore in accordance with the present disclosure.

FIG. 1 illustrates a wellsite 100 with a land based drilling rig 102 for drilling a wellbore 104 into a subterranean formation 106. A drilling tool (or bottomhole assembly (BHA)) 108 is deployed from a wellhead 107 of the rig 102 via a drill string 110. Drilling tool 108 has a bit 109 at its lower end. Drilling tool 108 is rotationally driven and bit 109 advances into formation 106 to form a wellbore 104. While the system shown is land-based, the systems, apparatuses and methods of the present disclosure are equally applicable to offshore operations (see, e.g., FIG. 2).

A mud pit 112 containing drilling mud 114 may be provided at the surface. The mud 114 may be pumped into drill string 110, through drilling tool 108 and out through drill bit 109 as indicated by the downward arrows. Mud 114 exits drill bit 109 and is pumped back up to the surface for recirculation as indicated by the upward arrows. Mud 114 is typically pumped at a desired pressure and, in some instances, solids from mud 114 may line wellbore 104 so as to form a mudcake 115 along the wall of the wellbore. Circulation may initiate either down the drillpipe or casing and up the annulus or down the annulus and up the drill pipe or casing. Circulation may also be both down the drillpipe or casing and down the annulus simultaneously. Heat may be generated in a portion of formation 106 surrounding wellbore 104, as indicated by the arrows 113, using various means, including but not limited to electric, fluid and mechanical means. For example, one or more heaters (or other heating devices) 111 may be positioned in or around wellbore 104 to apply heat into the subterranean formation 106. Such heaters may be in the form of a friction generator, electrode, electrical conduit or other device, or employ microwave, ultrasonic, infrared (e.g., OH stretch), near infrared (e.g., overtone of OH stretch), or other wave technologies. Examples of heaters are provided in U.S. Pat. No. 7,121,341. As shown, heaters 111 may variously be positioned in mud pit 112 to heat mud 115 pumped into the wellbore via the drill string, deployed into the wellbore 104 and suspended therein, and/or positioned in formation 106, for example, by drilling into the formation 106.

Other fluids, such as a conduction fluid 117 may be pumped from a fluid source 118 into the wellbore 104. As shown, conduction fluid 117 may follow drilling mud 114 through drilling tool 108. Conduction fluid 117 may be heated, for example, using a heater at the fluid source, by exothermic reaction, or by other means before or after entering the wellbore 104 as will be described more fully herein.

Heat may also be generated by mechanical means. For example, rotation of the drill string 110, drilling tool 108 and/or drill bit 109 and/or engagement with the formation 106 may be used to generate heat. Other friction generators or devices may be provided for generating friction in the wellbore to generate the desired heating.

A surface unit 116 is preferably provided at the surface to monitor and/or control the drilling operations. Sensors S may be provided for measuring parameters such as temperature, pressure, stresses, etc. Downhole monitoring may be provided by one or more downhole sensors and/or tools such as are known in the art for monitoring downhole parameters, such as fluid, formation and/or wellbore properties. These parameters may be collected and analyzed by the surface unit 116 and/or downhole tool 108. Surface unit 116 preferably has communication, memory processor and/or other devices for performing desired control operations at the wellsite. Surface unit 116 may also communicate with various equipment at or away from the wellsite.

Surface unit 116 may be used to collect downhole data from downhole sensors and/or tools (e.g., drilling tool 108). Surface unit 116 may also monitor downhole conditions, such as wellbore temperatures, temperatures of the fluid (e.g., drilling mud 114 and/or conduction fluid 117) and/or heaters 111. The surface unit 116 may also include a controller to adjust wellbore operations based on the collected data. The surface unit can be used to predefine temperatures and adjust the operations as needed.

Temperatures and duration of heating may be selected to achieve the desired heating to generate desired formation properties, such as a desired hoop stress and fracture gradient of the formation 106. Selected configurations may be used for wellbore strengthening to improve the pressure-fracture gradient window and optimize zonal isolation. In another example, temperature effects on rock strength may be used to manipulate the rock strength during the drilling operation to prevent, mitigate and/or remediate lost circulation events. The temperature during cementing may also be used to increase rock strength to achieve a desired cement lift in zonal isolation.

By modeling mechanical behavior of the formation, apparent formation strengthening in the near-wellbore can be achieved for a specific wellbore shape, trajectory and/or depth via modification of the hoop stress around the wellbore. The heating may also be selectively positioned at a given interval of the wellbore to affect portions of the subterranean formation thereabout. Formation strengthening via hoop stress increase (reinforcement) will result in increased apparent fracture gradient, thus increasing the working window between the fracture gradient and dynamic pressure profile.

The thickness of the near-wellbore region that is preferably affected by the processes of the present invention depends in part on the formation itself. Specifically, if the thermal response of the formation material is small, a greater thickness of the near-wellbore will need to be influenced in order to achieve a desired amount of strengthening. Conversely, if the thermal response of the formation material is large, a thinner portion of the near-wellbore can be treated in order to achieve a desired amount of strengthening. This principle is reflected in the equation $d/r_w \propto MW_0/\Delta HoopStress$, where d is the thickness of the treated area, $r_w$ is the wellbore radius, $MW_0$ is initial strength of the formation, and ΔHoopStress is the change in hoop stress due to heating. According to preferred embodiments of the present invention, d is calculated using known or estimated properties of the subject formation. Alternatively, an effective treated thickness d can be estimated using a value for d between 10% and 1000% of the wellbore radius. Values for d between 100% and 1000% of the wellbore radius are be suitable for formations with relatively small thermal responses, whereas values of d between 10% and 100% of the wellbore radius are be suitable for formations with relatively large thermal responses. Thus, the practitioner can use known properties of the formation, including initial strength, thermal responsiveness, and heat capacity to determine how much heat to remove or provide to the target region.

In particular embodiments, the near-wellbore hoop stress is increased so as to allow for increased apparent rock strength in the near-wellbore. This is preferably achieved by:

a) cooling a near-wellbore region of the formation;

b) allowing lost circulation materials to enter the cooled near-wellbore region; and c) heating the LCM-containing near-wellbore region.

Suitable lost circulation materials are preferably fibrous or granular and may include a particulate with wide particle size distribution and/or a fluid with thixotropic properties with or without exothermic properties, such as Frac-Attack, Venseal, G seal, or other types of lost circulation fluids. Lost circulation materials can be either organic or synthetic in composition and can be inert or react with the wellbore fluids and should provide at a minimum stabilization of the hoop stress during the cementing process.

During the cooling step, the temperature of the near-wellbore region is preferably reduced by at least 10° F. (6° C.) below current near-wellbore temperature. The near-wellbore region is preferably cooled sufficiently to reduce hoop stress in the near-wellbore region by at least 50 psi. Depending on the specific downhole environment, it may take between 5 and 50 minutes to achieve the desired degree of cooling. The reduction in near-wellbore temperature can be achieved by circulating cooling agents. Reducing the near-wellbore temperature contracts the rock and reduces the hoop stress, thus increasing the size of micro-fractures that might exist in the formation. If particulate matter of a corresponding size distribution (predicted via geomechanical models) is present, those particles will enter the fractures and lodge themselves therein.

In the case of weakly or unconsolidated sandstone formations there will be no fractures as such but the particulate matter from circulating fluid can be placed into formation by means of infiltration. As has been shown, the degree of infiltration strongly depends on the ratio of $Ds_{50}$ of the formation particle size distribution to $Dp_{50}$ of infiltrating particles. If $Ds_{50}/Dp_{50}<5\text{-}6$, the particles will not infiltrate formation, whereas if $Ds_{50}/Dp_{50}>25$, the infiltrating particles can travel through formation. The optimum range of the particulate matter in circulating fluid should be chosen being in this interval: $6<(Ds_{50}/Dp_{50})_{optimum}<25$. The larger particles (with $Dp_{50}\sim(Ds_{50})/6$) can invade formation and significantly decrease porosity which in turn will strengthen formation (the lower porosity, the stronger the rock other things being equal) but at the same they can't travel far so that affected near-wellbore domain is not large. The smaller particles with $Dp_{50}\sim(Ds_{50})/25$ can travel far and affect a larger near-wellbore vicinity but are less efficient in decreasing porosity and strengthening fabric. A certain sequence of circulating fluids might be optimally chosen as the first one, containing small particulates, and then that with larger particles inside the aforementioned interval of $Ds_{50}/Dp_{50}$.

Cooling of the formation may be accomplished by circulating fluids that are cool relative to the formation, by circulating fluids that undergo an endothermic reaction while downhole. In instances where a fluid loss has already occurred, cooling may not be required and the desired outcome could be achieved by emplacing lost circulation materials and heating the near-wellbore.

Once the lost circulation materials has entered the fractures, the temperature of the near-wellbore is preferably increased by at least 6° C. above the temperature to which it was previously cooled. In preferred embodiments, the near-wellbore region is heated sufficiently to increase hoop stress in the near-wellbore region by at least 50 psi. Depending on the specific downhole environment and rate of heating, it may take between 5 and 50 minutes, or longer, to achieve the desired degree of heating.

When the temperature is increased, the rock expands thus acting to close the fractures. However, the lost circulation materials lodged in the fractures prevent fracture closure, thus inducing additional stresses. This ensures that the hoop stress in the near-wellbore is increased and fractures are stabilized (i.e., do not propagate). This increase in hoop stresses and improved apparent fracture gradient allow for improved cement placement, as a higher pressure can be applied/tolerated.

The desired heating can be achieved using exothermic fluids or other heat-generating methods, with or without conventional wellbore strengthening particulate materials. In some embodiments, the placement of lost circulation materials may be carried out simultaneously with either the cooling or the heating step. In some embodiments, the lost circulation materials may interact exothermically with fluid in the wellbore.

Figure 2:
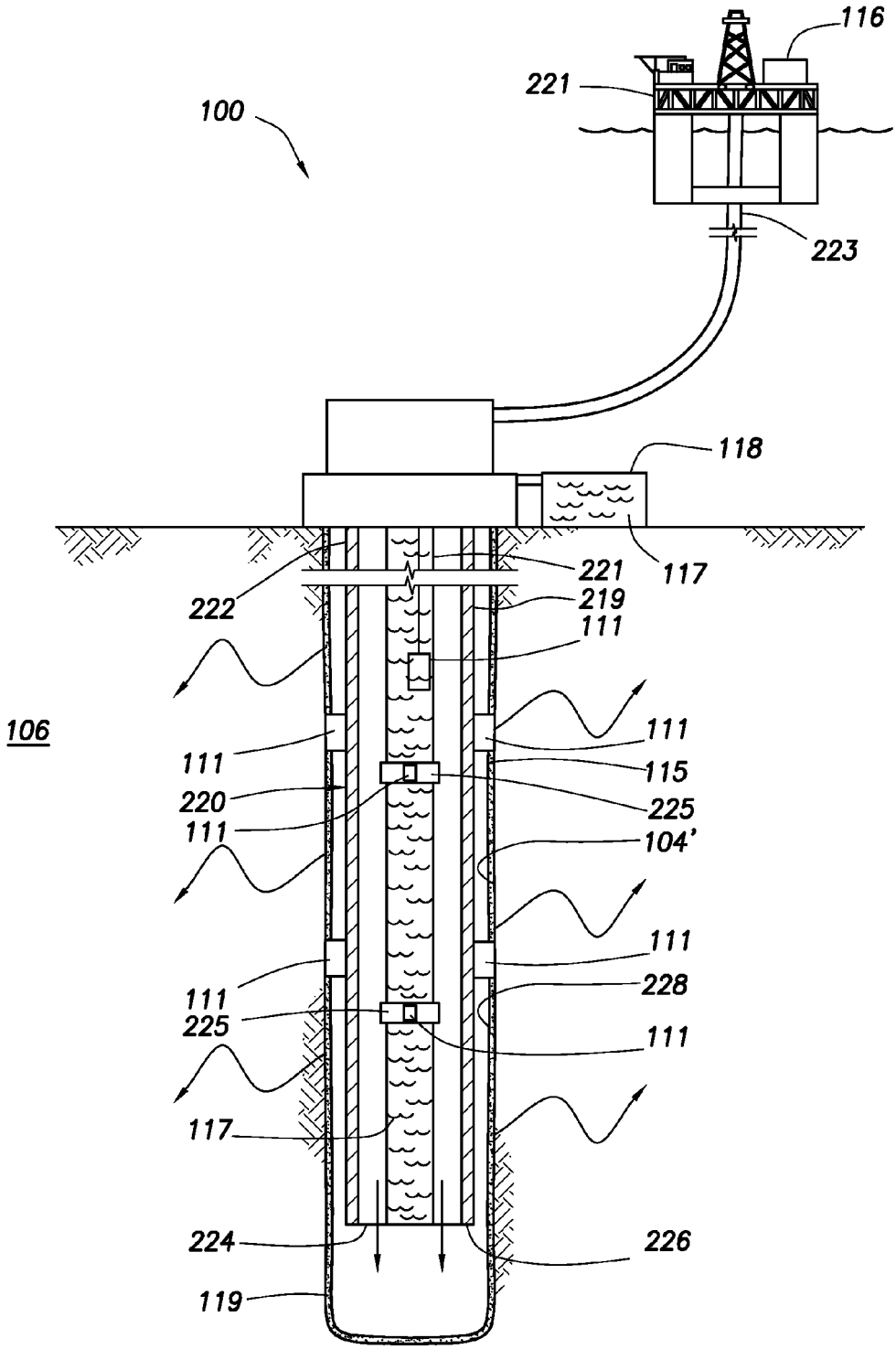
FIG. 2 is schematic diagram, partially in cross-section depicting heating while casing the wellbore in accordance with the present disclosure.

It will be understood that the principles disclosed herein are suitable for any drilling operation, and are not limited to onshore drilling. FIG. 2 shows an offshore wellsite 100'. The wellbore 104' may be the same as the wellbore 104, but is depicted in an offshore configuration for descriptive purposes to show a version of the operation in a subsea environment. Wellsite 100' has a platform 221 positioned about a wellbore 104' penetrating a subterranean formation 106'. Subsea drilling pipe 223 operatively connects the platform 221 to the wellbore 104' for receiving fluids therefrom. In this offshore version, wellbore 104' has a wellhead 225 with a BOP 227 at an upper end thereof for fluidly coupling the subsea drilling pipe 223 to the wellbore 104'. A surface unit 116' is positioned at the platform for communication and control of the wellsite 100'. Wellsite 100' may be provided with other subsea equipment not shown, such as manifolds, separators, pumps, etc.

In the embodiment shown in FIG. 2, wellbore 104' the drilling bit has been removed, and a casing string 220 has been deployed into wellbore 104' to line a portion thereof in a casing operation. Casing string 220 may be a conventional casing 219 (and/or liner) positionable in the wellbore 104 to provide zonal isolation therein and/or for passage of fluid therethrough.

When disposed into wellbore 104, casing string 220 defines a passageway for the passage of tools, drilling pipe and/or fluids therethrough. Casing string 220 preferably includes a top end 222 near the surface, and a casing shoe 224 at a bottom end 226 thereof. The casing 219 may be a conventional steel casing capable of conducting heat. The liner may be a conventional liner along an inner surface of the casing. Casing string 220 may be supported in wellbore 104 by a downhole tool (not shown) used to deploy the casing 219 and/or liner using a surface support (not shown).

In some embodiments, an annulus 228 may be provided between the c casing 220 and a wall 230 of the wellbore. Mudcake 115 may line the wellbore 104 in the annulus between the casing 220 and the wall 230 of the wellbore 104.

As discussed above with respect to FIG. 1, the formation 106 may be heated using electric, fluid and/or mechanical means. As shown in FIG. 2 (but not to scale), the wellsite 100' may also be heated by heaters 111 operatively connected to the casing 219. The casing 220 may also have heaters 111 positioned at couplings 225 between individual portions of the drilling pipe 221. In a similar manner, heaters 111 may also be positioned at couplings or connections between individual portions of casing (not shown). In this example, the heaters 111 may be, for example, electrodes coupled to the casing 219 and using the casing 220 as a conductor for passing heat through the wellbore 104'. Casing 220 may be used, for example, as an induction coil for receiving an electrical current from a surface source to heat surrounding formation 106. Additional heating by mechanical means may be provided, for example, by rotation of the downhole drilling pipe 220 from the surface.

Heat may also be applied to the formation 106 by passing conduction fluid 117 into the wellbore 104' via a coiled (or other) tubing 221. The conduction fluid 117 may be disposed into wellbore 104 via coiled tubing 221, and into the annulus 228 between the downhole tubing 220 and the wellbore wall, or the annulus between coiled tubing 221 and casing 220. Conduction fluid 117 acts as a conductor to heat casing 220 and the surrounding wellbore 104'. Conduction fluid 117 may be distributed through select portions of the wellbore 104' to heat select intervals of the formation 106 surrounding the wellbore 104'. The heat from the conduction fluid 117 may be generated in the wellbore 104 and pass into the surrounding formation 106 as indicated by the wavy arrows.

Figure 3:
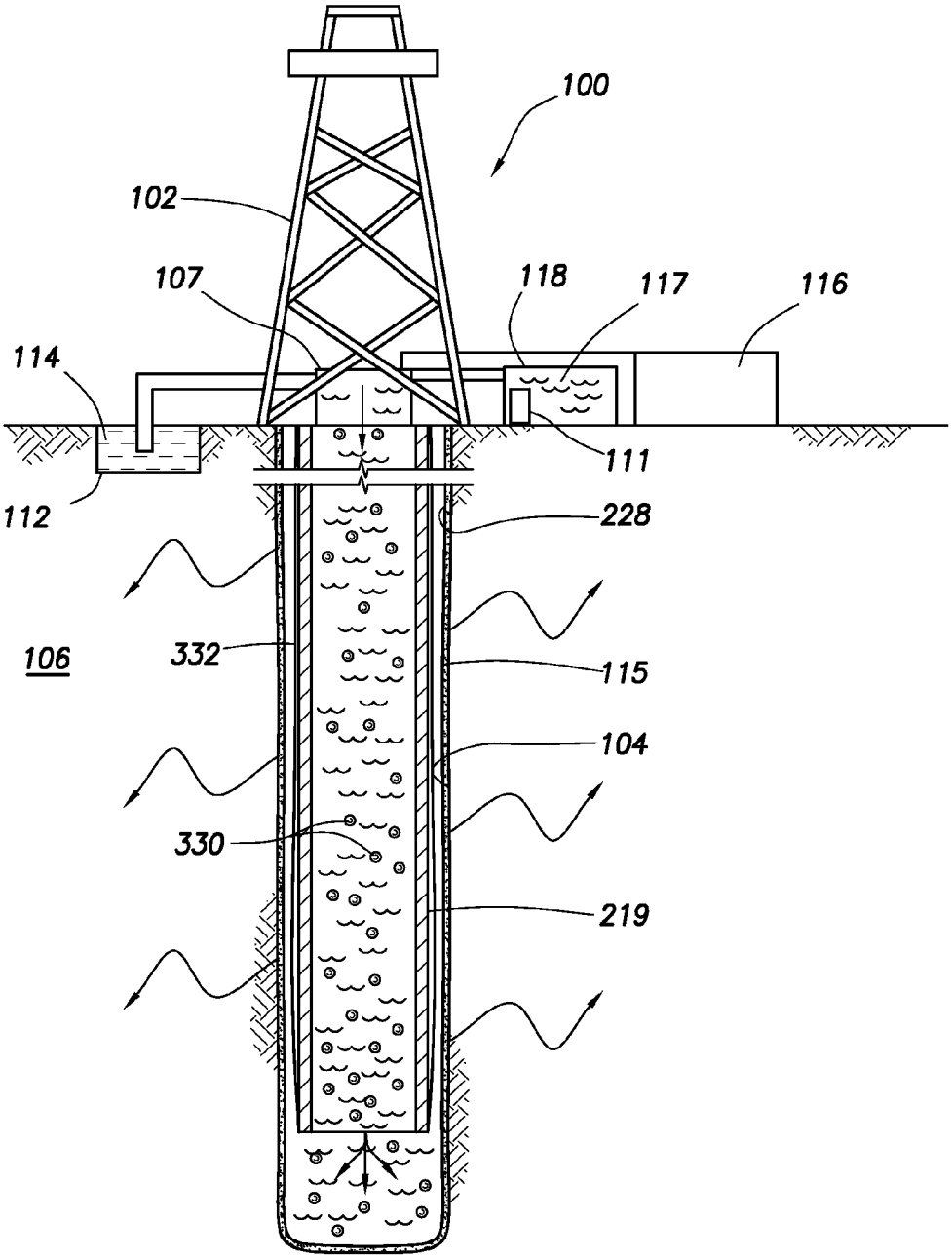
FIG. 3 is schematic diagram, partially in cross-section depicting heating while treating the wellbore in accordance with the present disclosure.

FIG. 3 depicts the wellsite 100 during a treatment operation. Alternatively or in addition to any of the techniques as described in FIGS. 1 and/or 2 above, wellsite 100 may be heated using a conduction fluid 117 that may be preheated using heaters 111 and/or heated by chemical reaction. Heaters 111 may be provided at the fluid source 118 to preheat the conduction fluid 117 before disposal into the wellbore at other locations to heat the conduction fluid 117 downhole. The conduction fluid 117 may be selectively heated and distributed at a desired temperature, pressure, flow rate and/or other fluid properties, and pumped for a given duration to achieve the desired formation parameters (e.g., hoop stress, rock strength, etc.)

The conductive fluid 117 may also be an exothermic fluid that generates heat upon reaction. A chemical reaction of the conductive fluid 117 may be triggered, for example, upon contact or by time release of chemicals. Designed or controlled reaction may be used to time the reaction and control the location and strength of the reaction.

In another embodiment, casing 219 may be provided with a coating 332 that reacts with conduction fluid 117 upon contact therewith. Once deployed into the wellbore 104, the conduction fluid 117 will generate heat upon contact with the coating 332. The coating 332 may be configured to react with the conduction fluid 117 to generate the reaction at a desired timing and location. For example, the coating 332 may cause an exothermic reaction upon contact, thereby activating the conduction fluid 117 in situ at a desired location or interval. The coating 332 may be selected to achieve the desired chemical properties of the conduction fluid 117 during downhole heating operations.

While coating 332 is depicted along the casing 219, the coating (or other chemicals, materials, etc.) may be provided about any surface, drilling pipe, or other device. Other items reactive with the conduction fluid 117 may also be positioned in the wellbore 104 to generate exothermic reactions as desired.

In another example, time release pellets 330 may be included in the conduction fluid 117 and/or separately positioned in the wellbore 104 for time delayed release of chemicals. The conduction fluid 117 and/or time release pellets 330 may have a chemical reaction at the surface and/or downhole to generate heat in the wellbore 104. The time release pellets 330 may dissolve in the wellbore 104 at a given time to initiate an exothermic reaction with the conduction fluid 117. Properties of the conduction fluid 117 and/or time release pellets 330 may be selectively adjusted to provide the desired heating at the desired timing and location.

Conduction fluid 117 may be in a variety of physical states or phases, such as gas, liquid, solid and/or combinations thereof. As shown in the figures, conduction fluid 117 is preferably in liquid form. Conduction fluid 117 preferably remains in the liquid phase after the desired heating. By remaining in a liquid state, the conduction fluid 117 may be more easily removed from the wellbore on completion of the heating. The form of the liquid conduction fluid 117 may optionally be adjusted to facilitate use thereof.

In some cases, conduction fluid 117 may be difficult to transport through the wellbore 104. Where the clearance or space in the annulus 228 may be narrow and/or have tighter clearances for placement of the casing 219 (e.g., deepwater), frictional forces may be increased and fracture gradients reduced from depletion and compaction and small pore pressure fracture gradient windows. Thus, the viscosity of the conduction fluid 117 may optionally be adjusted to facilitate passage into annulus 228.

Figure 4:
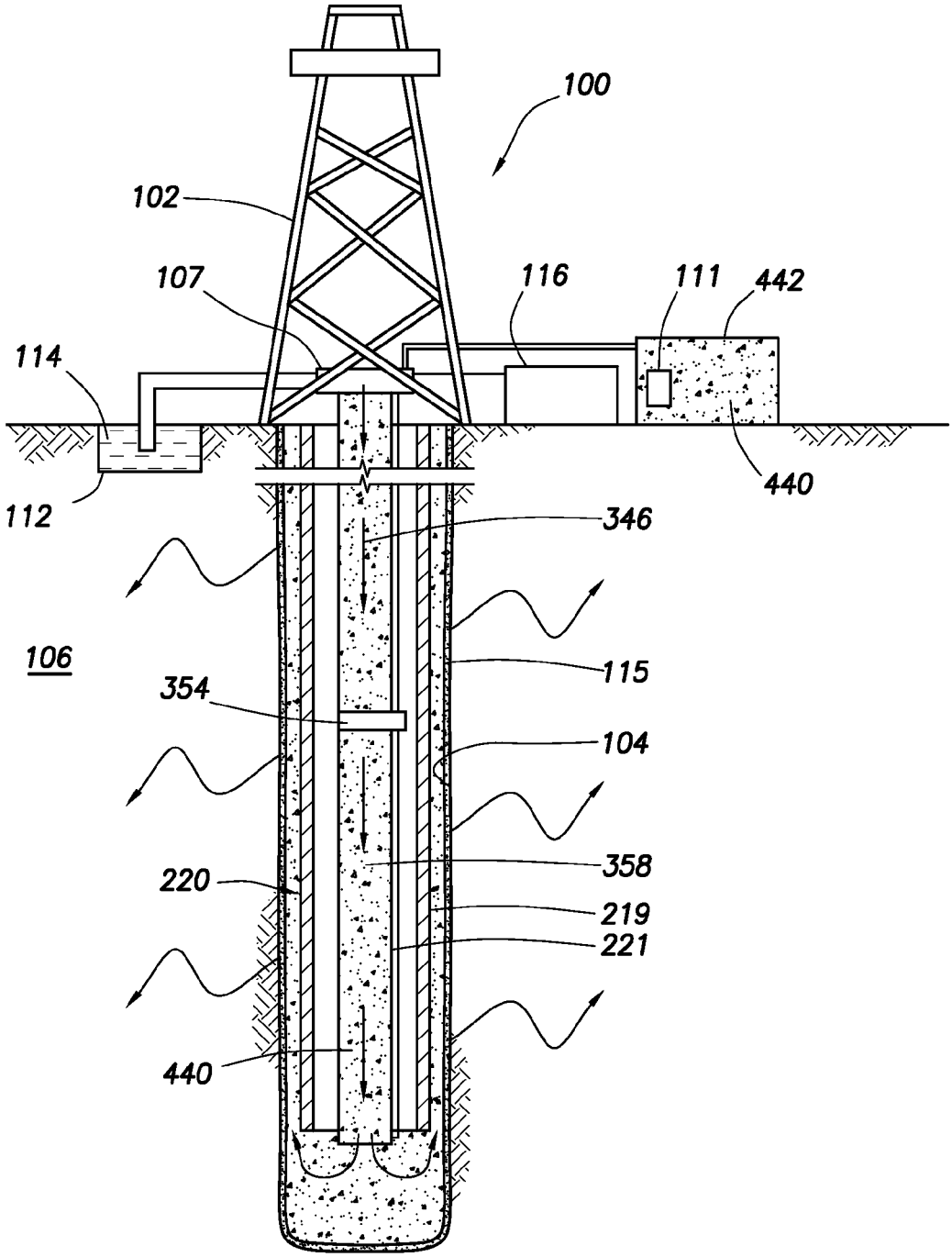
FIG. 4 is schematic diagram, partially in cross-section depicting heating while cementing the wellbore in accordance with the present disclosure.

One option would be to spot a fluid which may or may not contain sized particulate or fibrous material after drilling and before running casing that might set upon thermal activation to provide a stable wellbore and mitigate or remediate a lost circulation FIG. 4 depicts the wellsite 100 during a cementing operation. FIG. 4 is the same as FIG. 3, except that conductive fluid 117 and fluid source 118 have been eliminated and cement 440 is disposed into the wellbore 104 from a cement source 442. Cement 440 may be pumped into the wellbore 104 through casing 221 via tubing 219. The cement 440 may also be pumped through the wellbore 104 and into the annulus 228 between the downhole tubing 220 and the wall 115 of the wellbore 104, and solidifies therein to secure the casing 220 to the wall 230 of the wellbore 104 as indicated by the arrows.

The formation 106 may also be heated by heating the cement 440 and disposing the heated cement 440 into the wellbore 104 during the cementing operation. The cement 440 may be selectively heated and distributed at a desired location in the well. The cement 440 may be preheated at the surface, or heat from the cement 440 may be generated in the wellbore 104. The cement 440 may be preheated, for example, using the heater 111. The cement 440 may also contain exothermic chemicals that generate heat by chemical reaction in a similar manner as the conductive fluid 117 as previously described. The cement 440 may be configured to generate heat at a desired temperature, pressure flow rate and/or other fluid properties, and pumped for a given duration. The cement source 442 may also be selectively heated to permit the cement 442 to be positioned about the casing 219 and set at a desired timing.

Figure 5:
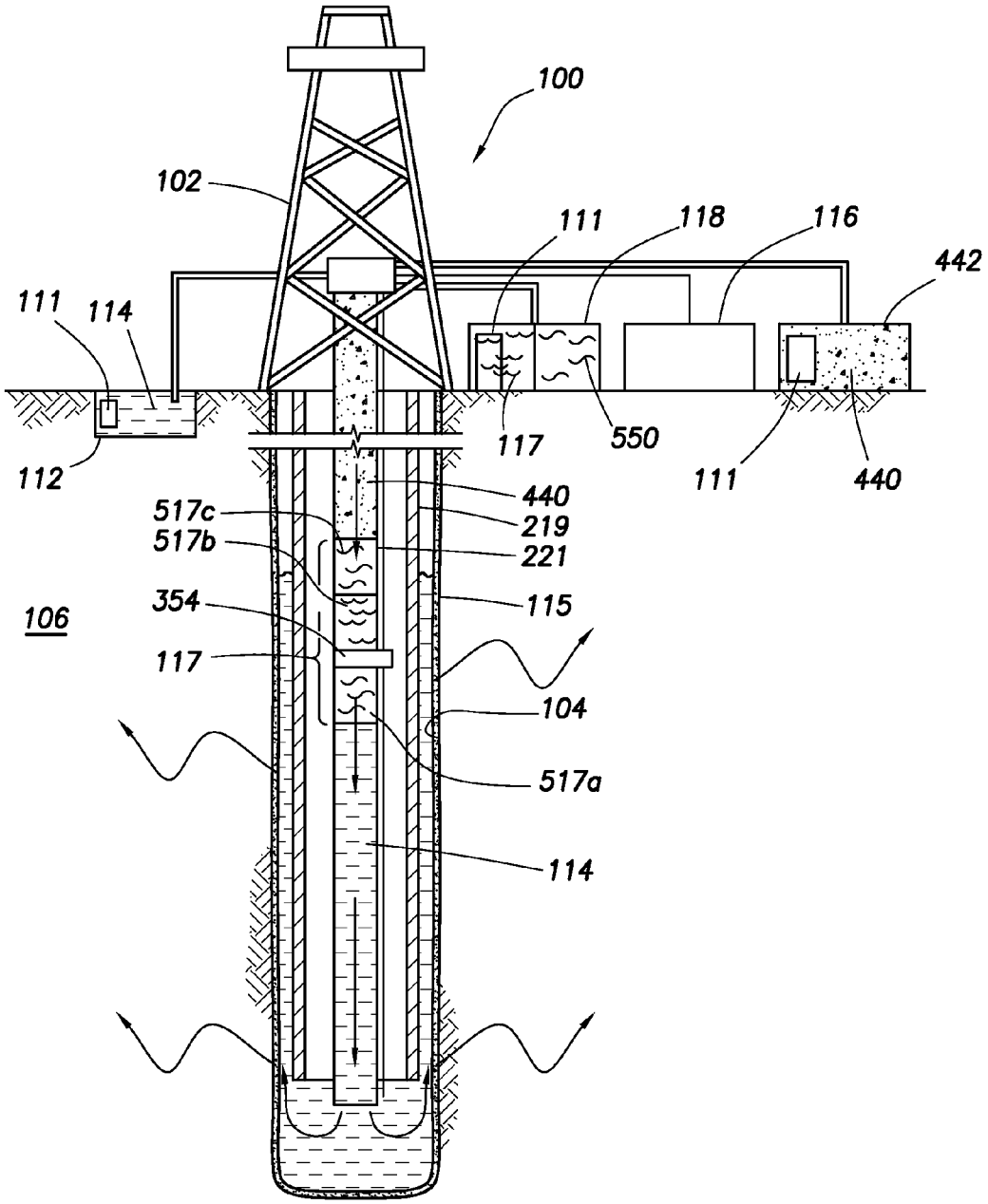
FIG. 5 is schematic diagram, partially in cross-section depicting heating while treating and cementing the wellbore in accordance with the present disclosure.

FIG. 5 depicts the wellsite 100 during a combined treatment and cementing operation. This view is similar to FIGS. 3 and 4, but contains the drilling mud 114 with surface pit 112, the conductive fluid 117 with fluid source 118 and the cement 440 with cement source 442. In this version, the drilling mud 114, conductive fluid 117 and the cement 440 may be disposed into the wellbore 104 through tubing 221. While the fluids are depicted as being pumped through coiled tubing 221, pumping of various fluids herein may be passed into the wellbore through downhole tubing 220 or other tubing. As mentioned above, the wellsite 100 may be heated by passing various fluids, such as drilling mud 114, conductive fluid 117 and/or cement 440, into the wellbore through tubing 221 to heat the formation as indicated by the wavy arrows. Various combinations of fluids may be pumped into the wellbore 104 in desired amounts and at desired rates. As shown, drilling mud 114 is pumped into the wellbore 104 and into the annulus 228 behind casing 219. The drilling mud 114 may be pumped to line the wellbore 104 and form the mudcake 115.

After a certain amount of mud is passed through the coiled tubing 221, conduction fluid 117 may be passed into the coiled tubing 221. The conduction fluid 117 may include various combinations of fluids, such as one or more spacers 517*a,b,c*. These fluids may be pumped from the treatment source 118, through tubing 221 and into the wellbore. The conduction fluid 117 may include, for example, a load (or initial) spacer 517*a*, an exothermic spacer 517*b* to generate heat, and a tail (or end) spacer 517*c*. The load and tail spacers 517*a,b* may be the same material that isolates the exothermic spacer 517*b* from the mud 114 and/or the cement 440. The exothermic spacer 517*b* may be the same as the conduction fluid 117 described herein.

The cement 440 may then be pumped from a cement source 442 and into the wellbore 104. The cement 440 may be pumped through the wellbore 104 and into the annulus 228 between the downhole tubing 220 and the wall 115 of the wellbore 104 to secure the casing 221 in the wellbore 104. The cement 440 is deployed through the tubing 221 after the conduction fluid 117. Once the heated conduction fluid 117 is depleted, the cement 440 is pumped through the tubing 340 and into the wellbore 104. The cement 440 may be pumped immediately after the pumping of the conduction fluid 117, or after a delay to allow the formation to react to the increased temperatures.

If desired, delays may be provided between the various fluids to allow the fluids to transport, react, set, or for other reasons. If desired, combinations of various fluids may be deployed simultaneously or in various sequences to achieve the desired heating and/or operation. The pumping may be performed for sufficient time to achieve the desired downhole parameters (e.g., hoop stress of the formation 106). A delay may be provided after pumping until the desired parameters (e.g., heating of the formation 106) are achieved. While FIG. 5 is depicted as having the conduction fluid 117 and the cement 440 deployed sequentially through the same tubing 221, one or more tubings 221 may be used to pump one or more conduction fluids 118 and/or cements 440 into the wellbore 104.

The conduction fluids 117 used herein may be, for example, an exothermic spacer fluid coupled with temperature inert slurries used as the cement 440. The fluid used as the conduction fluid 117 may be configured to be a 'time-released' fluid to allow for heat transfer to the formation 106 at a desired time and/or rate. The formation 106 may also be heated to reduce ballooning and post placement contamination of the cement 440 with the conduction fluid 117.

The conduction fluid 117 may be in liquid form with particulate material, such as paramagnetic nanoparticles or metal particles, therein. The particulate material may have selected thermal expansion properties activatable upon heating of the treatment fluid 117. In a given example, the particles may consist of smart materials (eg. Polymers, various alloys, aluminum, Iron, PVC, etc) and may be heated by high frequency electromagnetic radiation. The particulate material preferably has a concentration selected to achieve the desired expansion properties.

Exothermic conduction fluids coupled with temperature inert lost circulation materials (e.g. sized carbonates, gilsonite, graphite, fibers of various types that may include cements (or slurries) may be used to facilitate placement that may result from increased near-wellbore fracture gradient. The placement techniques and type of fluids may be selected to provide the desired heating and resulting rock strength. Exothermic reactions can be engineered to be "time-released" and a planned hesitation during the job execution performed during the placement process to allow for appropriate heat transfer prior to increasing the flow rates during the cement placement stage. Increased rock strength may be targeted to reduce the probability of ballooning and/or the likelihood of post placement mud-cement contamination.

Heating as used herein may also involve flowing electric current between tunnels, using thermal processes, employing a conduit containing a hot fluid, using geothermal energy, using heat transfer for combustion of fuel heating, inductively coupled plasma (ICP)/IUP electrical heating, heat transfer from a hot fluid (e.g., such as a molten salt, a molten element (sodium or another metal), or some other material (steam, other)), dissolution of an acid or base (e.g., in water—sulfuric acid (~100%), nitric (10+M), solid metal hydroxide (NaOH, $Ca(OH)_2$, etc.)), dissolution of a metal chloride in water (e.g., —$AlCl_3$, for example—forms $Al(OH)_3$+HCl, which is highly corrosive), reaction of an acid and a base, in-situ oxidation, combustion of hydrocarbons, electromagnetic heating (e.g., microwaves; heat local water to drive otherwise sluggish oxidation or other heat-generating reaction to occur locally and then, if the reactants are sufficiently concentrated farther out into the formation, to propagate out from the wellbore), infrared, plasma (e.g., for heating black oil to very high temps). Longer-distance heating may involve well treating process for chemically heating and modifying a subterranean reservoir (e.g., chemicals used in removing wax deposits from pipelines—reaction can be tuned for particular times to allow very selective heating), injection of conductive material into multiple fracs in a horizontal well, "rubblizing" the formation with an underground explosion followed by injection of externally heated $CO_2$ (e.g., at 500° C. or thereabouts).

While FIGS. 1-5 show various optional techniques for heating a formation 106 with a conduction fluid 117, one or more of the techniques or portions thereof may be performed to achieve the desired heating and resulting properties of the surrounding formation 106. The release of the fluids, fluid parameters (e.g., pressure, temperature, flow rate), time release reactions and other characteristics of the conduction fluid 117 and/or the use of such conduction fluid 117 may be implemented to maximize the reaction time in place.

Figure 6:
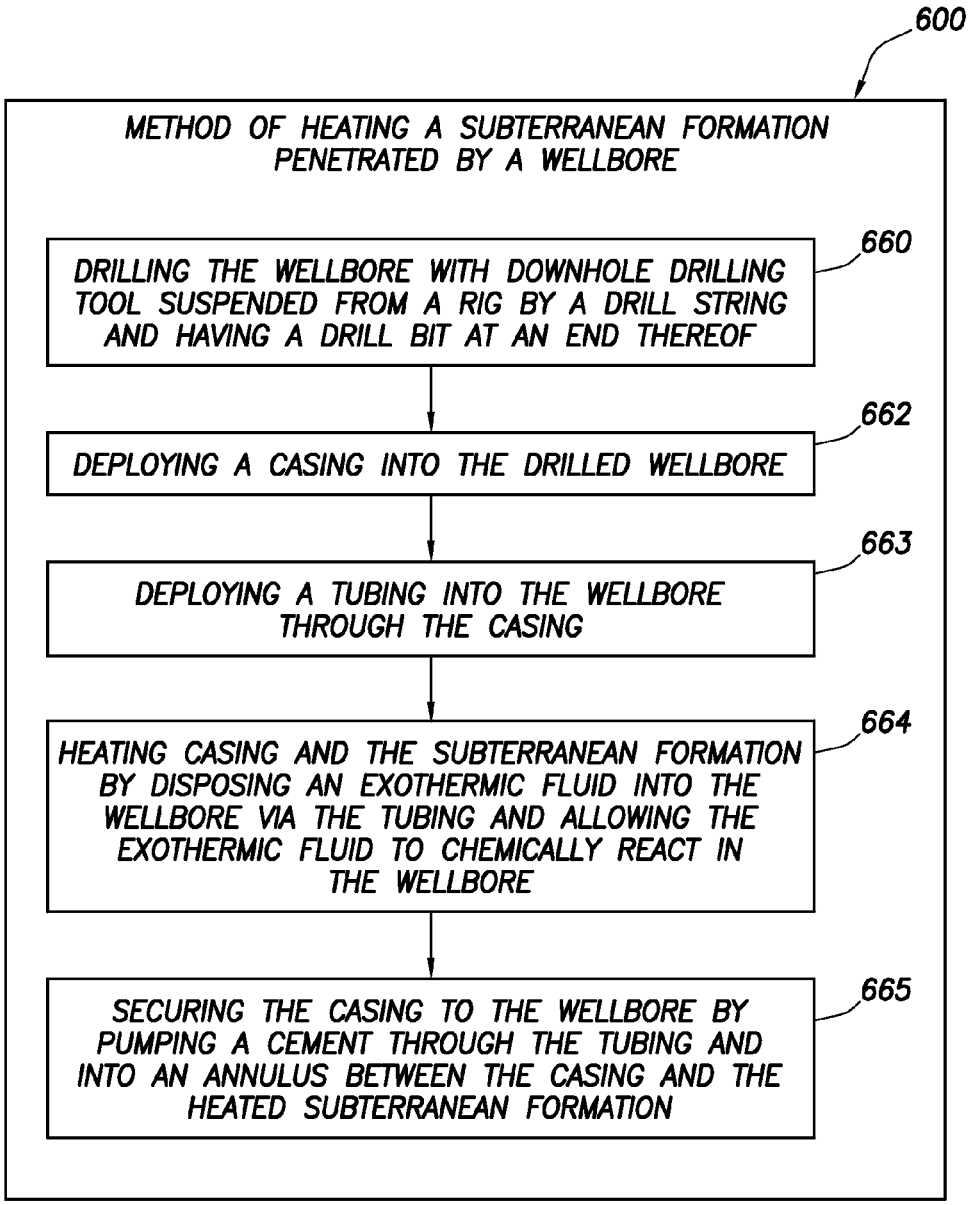
FIG. 6 is a flow chart depicting a method for heating a formation in accordance with the present disclosure.

FIG. 6 depicts a method 600 of heating a subterranean formation penetrated by a wellbore. The method involves 660—drilling the wellbore with a downhole drilling tool suspended from a rig by a drill string and having a drill bit at an end thereof, 662—deploying a casing into the drilled wellbore, 663—deploying a drilling pipe into the wellbore through the casing, 664—heating the subterranean formation about the wellbore by disposing a conductive fluid comprising an exothermic liquid into the wellbore via the drilling pipe and generating heat about the wellbore while maintaining a liquid structure thereof (the conductive fluid being non-reactive to cement), and 665 securing the casing to the wellbore by pumping a cement through the drilling pipe and into an annulus between the casing and the heated subterranean formation.

The method may also involve other features, such as pausing between the heating and the securing, disposing at least one spacer through the drilling pipe, generating heat in the wellbore by rotating the casing, positioning at least one heater about the wellsite and emitting heat therefrom, coating the casing with an exothermic material heat reactive upon contact with the conduction fluid. The method may be repeated as desired and performed in any order.

While the embodiments are described with reference to various implementations and exploitations, it will be understood that these embodiments are illustrative and that the scope of the inventive subject matter is not limited to them. Many variations, modifications, additions and improvements are possible. For example, one or more chemical and/or mechanical techniques as described herein may be used to heat the wellbore.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method of increasing near-wellbore hoop stress so as to increase the apparent rock strength in the near-wellbore in a subsurface formation so as to mitigate or remediate lost circulation events, the method comprising:

a) cooling a near-wellbore region of the formation in relation to a treated thickness d, a wellbore radius $r_w$, an initial strength of the formation $MW_0$, and a predicted change in hoop stress due to heating ΔHoopStress;

b) allowing a lost circulation material to enter the cooled near-wellbore region; and c) heating the near-wellbore region, wherein step a) further includes calculating the treated thickness d using the equation $d/r_w \propto MW_0/\Delta HoopStress$.

2. The method of claim 1 wherein the treated thickness d is between 10% and 1000% of the wellbore radius.

3. The method of claim 1 wherein step a) includes lowering the temperature of the near-wellbore region by at least 10° F. (6° C.).

4. The method of claim 1 wherein step a) includes lowering the temperature of the near-wellbore region to 10° F. (6° C.) or below current near-wellbore region temperature.

5. The method of claim 1 wherein step a) includes cooling the near-wellbore region sufficiently to reduce hoop stress in the near-wellbore region by at least 50 psi.

6. The method of claim 1 wherein step a) includes cooling the near-wellbore region for at least 5 minutes.

7. The method of claim 1 wherein step c) and at least part of step b) are carried out simultaneously.

8. The method of claim 6 wherein the lost circulation material interacts exothermically with fluid in the wellbore.

9. The method of claim 1 wherein the lost circulation material comprises a particulate with wide particle size distribution or a fluid with thixotropic properties with or without exothermic properties.

10. The method of claim 1 wherein step c) includes raising the temperature of the near-wellbore region by at least 10° F. (6° C.).

11. The method of claim 1 wherein step c) includes raising the temperature of the near-wellbore region to at least 10° F. (6° C.) or above current near-wellbore region temperature.

12. The method of claim 1 wherein step c) includes heating the near-wellbore region sufficiently to increase hoop stress in the near-wellbore region by at least 50 psi.

13. The method of claim 1 wherein step c) includes heating the near-wellbore region for at least 5 minutes.

* * * * *